US006003483A

United States Patent [19]

Murphy et al.

[11] Patent Number: 6,003,483

[45] Date of Patent: Dec. 21, 1999

[54] YOKE MOUNT ROCKER ARM

[75] Inventors: Richard F. Murphy, Torrington; Primo Gugnoni, Goshen; Christopher Kaswer, Avon; Robert A. Niziolek, Plainville, all of Conn.

[73] Assignee: The Torrington Company, Torrington, Conn.

[21] Appl. No.: 09/159,538

[22] Filed: Sep. 23, 1998

[51] Int. Cl.[6] ..... F01L 1/18

[52] U.S. Cl. ..... 123/90.41; 29/888.2

[58] Field of Search ..... 123/90.39, 90.4, 123/90.41, 90.44; 74/519, 559; 29/888.2

[56] References Cited

U.S. PATENT DOCUMENTS

| | | | |
|---|---|---|---|
| Re. 33,870 | 4/1992 | Fittro et al. | 123/90.41 |
| 2,982,273 | 5/1961 | Bergmann | 123/90.39 |
| 4,476,822 | 10/1984 | Bonvallet | 123/90.41 |
| 4,724,803 | 2/1988 | Williams | 123/90.39 |
| 5,074,261 | 12/1991 | Hamburg et al. | 123/90.39 |
| 5,195,475 | 3/1993 | Murphy et al. | 123/90.39 |
| 5,297,509 | 3/1994 | Murphy | 123/90.39 |
| 5,313,916 | 5/1994 | Murphy | 123/90.39 |
| 5,329,891 | 7/1994 | Murphy et al. | 123/90.39 |
| 5,433,178 | 7/1995 | Urmaza | 123/90.41 |
| 5,437,209 | 8/1995 | Santoro | 74/559 |
| 5,645,025 | 7/1997 | Caya et al. | 123/90.42 |

*Primary Examiner*—Weilun Lo
*Attorney, Agent, or Firm*—John C. Bigler

[57] ABSTRACT

A shaft is mounted on side walls of a rocker arm, extending through a central cavity of the rocker arm. A bearing is located within the cavity of the rocker arm, positioned over the shaft. A yoke member adapted for mounting on the internal combustion engine has a curved portion enclosing a portion of the outer circumference of the bearing such that the bearing supports the rocker arm when the yoke mount rocker arm assembly is mounted on the internal combustion engine.

2 Claims, 1 Drawing Sheet

YOKE MOUNT ROCKER ARM

BACKGROUND OF THE INVENTION

This invention relates generally to a rocker arm and rocker arm mounting arrangement for use in an internal combustion engine.

Typical rocker arm mounting arrangements incorporate a bolt which goes through the approximate center of the rocker arm in the same basic plane as the rocker arm motion, intersecting the axis defining the rotation of the rocker arm. The bolt also goes through the shaft positioned within the rocker arm bearing, thereby requiring two separate bearings, one on each side of the bolt.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the invention, this is accomplished by providing a yoke mount rocker arm assembly comprising a yoke member and a rocker arm having side walls defining a central cavity. A shaft is mounted on the side walls of the rocker arm and extends through the central cavity of the rocker arm. A bearing is located within the cavity of the rocker arm, positioned over the shaft. The yoke member is adapted for mounting on the internal combustion engine and has a curved portion enclosing a portion of the outer circumference of the bearing such that the bearing supports the rocker arm when the yoke mount rocker arm assembly is mounted on the internal combustion engine.

In another aspect of the invention, this is accomplished by providing a method of assembling a yoke mount rocker arm assembly for mounting a rocker arm on an internal combustion engine.

The foregoing and other aspects will become apparent from the following description of the invention when considered in conjunction with the accompanying drawing figures.

BRIEF DESCRIPTION OF THE DRAWING FIGURES

DETAILED DESCRIPTION

Figure 1:
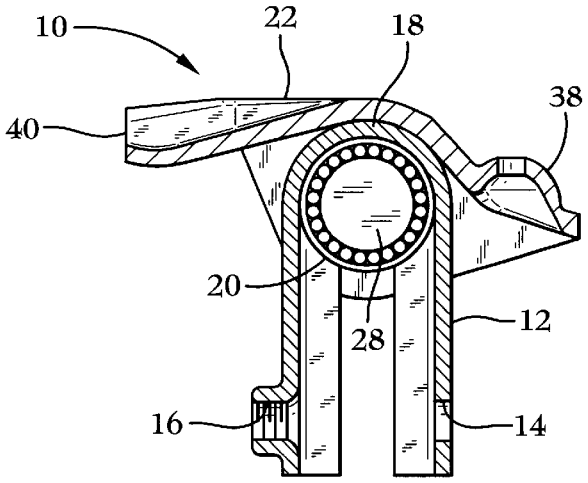
FIG. 1 is a lengthwise sectional view of a rocker arm and mounting arrangement illustrating the yoke mount rocker arm assembly of the present invention.
Figure 2:
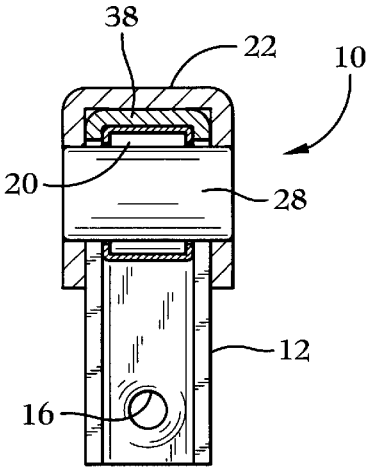
FIG. 2 is a cross sectional view of the rocker arm and mounting arrangement of FIG. 1, illustrating the yoke mount rocker arm assembly of the present invention.
Figure 3:
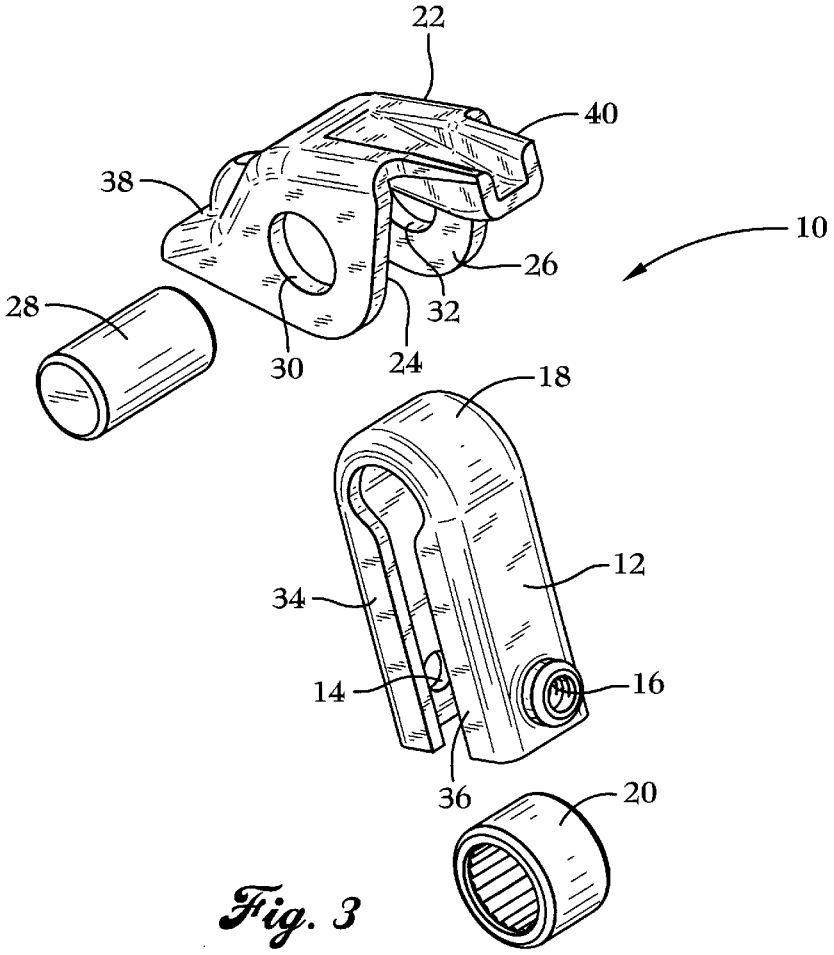
FIG. 3 is an exploded pictorial view of the rocker arm and mounting arrangement of FIGS. 1 and 2, illustrating the yoke mount rocker arm assembly of the present invention.

Referring now to the drawings, FIGS. 1 through 3 illustrate yoke mount rocker arm assembly 10 having a yoke 12 adapted for installation over a protrusion on the head of an internal combustion engine, not shown.

In the embodiment illustrated, a bolt inserted through an aperture 14, extending through the protrusion 14 and into a threaded portion 16 secures the yoke 12 to the protrusion, forming a pedestal extending outward from the head of the engine. The bolt securing the yoke 12 extends in a direction basically perpendicular to the direction of a typical mounting bolt of current rocker arm mounting arrangements, described above.

The yoke 12 has an inverted U-shape including a curved top portion 18 which is formed to conform to the outer circumference of a bearing 20 positioned within the yoke 12. Since the bolt securing the yoke 12 does not have to pass through the axis defining the rotation of the rocker arm and does not pass through a shaft positioned within the bearing 20, a single bearing can be used. The bearing 20 may be a full complement needle bearing, as illustrated, or may be a bearing of other known bearing configurations.

During assembly, the bearing 20 is positioned in the yoke 12, and the yoke 12 and the bearing 20 are inserted into a rocker arm 22. The rocker arm 22 of the illustrated embodiment has a basically inverted U-shape in the area of the bearing 20, with side walls 24 and 26 defining a central cavity. A shaft 28 is then inserted through holes 30 and 32 in the side walls 24 and 26, respectively, and is attached to the rocker arm by staking or other known method of attachment.

The rocker arm 22 is prevented from falling back over the yoke since the clearance between the curved top portion 18 of the yoke 12 and the bottom of the U-shape in the rocker arm 22 is kept to a minimum. Flange portions 34 and 36 of the yoke 12 provide abutment surfaces to limit movement of the rocker arm 22 away from the curved top portion 18 of the yoke 12. The rocker arm 22 is maintained in axial location centered on the bearing 20 by engagement of the yoke 12 by the side walls 24 and 26.

An end 38 of the rocker arm 22 has a cup adapted for contact with a push rod of the internal combustion engine and a basically inverted U-shape. The other end 40 is adapted for contact with a valve stem and has an inverted U-shape that is reversed to obtain clearance for a valve spring and maintain stiffness. The rocker arm 20 may have other configurations defining a central cavity for receiving the closed top portion 18 of the yoke 12 and may be formed by various methods.

After installation in the internal combustion engine, the push rod, valve stem and valve spring push the rocker arm 22 away from the head of the engine such that the bearing 20 is forced against the curved top portion 18 of the yoke 12 by the shaft 28. The bearing 20 thus supports the rocker arm 22, and the shaft 28 does not contact the yoke 12 as it rotates with the rocker arm 22 during operation of the internal combustion engine.

From the above description, it will be apparent that the present invention provides a convenient rocker arm mounting arrangement for an internal combustion engine that allows the use of a single bearing in place of the two bearings required with typical current rocker arm mounting arrangements.

Having described the invention, what is claimed is:

1. A yoke mount rocker arm assembly for installation on an internal combustion engine, the assembly comprising:

a rocker arm having side walls defining a central cavity;

a shaft mounted on the side walls of the rocker arm and extending through the central cavity of the rocker arm;

a bearing within the cavity of the rocker arm and positioned over the shaft, the bearing having an outer circumference; and a yoke member adapted for mounting on the internal combustion engine and having a curved portion enclosing a portion of the outer circumference of the bearing such that the bearing supports the rocker arm when the yoke mount rocker arm assembly is mounted on the internal combustion engine.

2. A method of assembling a yoke mount rocker arm assembly for mounting a rocker arm on an internal combustion engine, the method comprising:

positioning a bearing within a yoke member, the yoke member being adapted for mounting on the internal combustion and having a curved portion conforming to a portion of the outer circumference of the bearing;

positioning the yoke member within a central cavity of a rocker arm defined by side walls of the rocker arm; and mounting a shaft on the side walls of the rocker arm such that the shaft extends through the yoke member and the bearing.

* * * * *